United States Patent [19]

Nicoll

[11] Patent Number: 4,709,430

[45] Date of Patent: Dec. 1, 1987

[54] WEIGHTED BEACH BLANKET

[76] Inventor: Douglas E. Nicoll, 4637 Merrimack Ln., Virginia Beach, Va. 23452

[21] Appl. No.: 938,995

[22] Filed: Dec. 8, 1986

[51] Int. Cl.[4] ..... A47G 9/06

[52] U.S. Cl. ..... 5/417; 5/425; 5/482

[58] Field of Search ..... 5/417–420, 5/425, 485, 482

[56] References Cited

U.S. PATENT DOCUMENTS

| | | | |
|---|---|---|---|
| 4,137,584 | 2/1979 | Sharber | 5/417 |
| 4,607,402 | 8/1986 | Pollard | 5/425 |
| 4,634,618 | 1/1987 | Greer et al. | 5/417 |
| 4,644,173 | 7/1953 | James | 5/425 |
| 4,654,906 | 4/1987 | Roberts | 5/417 |

*Primary Examiner*—Alexander Grosz

*Attorney, Agent, or Firm*—Shlesinger, Arkwright & Garvey

[57] ABSTRACT

A multi-purpose weighted blanket for covering areas of beaches or like terrain comprising first and second flexible cloth panels substantially rectangular in shape and identical in size. The first and second cloth panels having a border extending continuously along the outer perimeter edges thereof forming a reinforced retaining pocket for securing an anchoring device thereto. The anchoring device includes a non-metallic tube filled with a liquid weight such as water. The non-metallic tube has a memory for restoring the tube to its original configuration upon the removal of an external force acting thereon. The anchoring devices operates to aid an individual in positioning the blanket as well as maintaining the blanket in its fully extended position. Additionally, the anchoring device prevents foreign particles such as sand or the like from soiling the reclining surface of the blanket.

15 Claims, 5 Drawing Figures

WEIGHTED BEACH BLANKET

FIELD OF THE INVENTION

This invention pertains to blankets and similar devices that are used to cover an area of beaches or like ground terrain.

BACKGROUND OF THE INVENTION

Numerous devices have been used to cover a particular section of the ground to protect an individual from the adverse characteristics of the terrain. Blankets, sheets and similar cloth coverings have been used by individuals on beaches, lawns and the like to provide the individual with a clean and comfortable surface to sit or lie on. U.S. Pat. Nos. 1,577,586; 1,624,797; 2,045,784; 2,344,010; 3,669,817; 3,774,249; 3,862,876; 4,137,584; 4,223,056; 4,272,575; 4,375,111; 4,466,516; 4,468,810; and 4,499,133 disclose devices that are commonly used as ground coverings.

A principle concern with ground coverings such as beach blankets, drop clothes, ground clothes, sheets and the ike is that these devices are readily subject to disarray from their fully extended covering position. Environmental, mechanical, and human forces act on beach blankets, for example, resulting in deformation thereof, thus significantly reducing the area of the ground protected. Additional concerns with beach blankets are the ease of placement and removal of the beach blanket to and from a particular area. Conventional ground cloths, of the type disclosed in the patents listed above, require two or more individuals to position the beach blanket or the like in order that it be fully extended. Further, conventional ach blankets being formed from a cloth-like material, when picked up for storing, tend to flap in the wind, making storage difficult. Additionally, foreign obstacles from the ground are usually projected outwardly when the blanket flaps in the wind. Individuals in the nearby vicinity are likely to be struck by the foreign objects causing discomfort and possible injury.

The beach blankets or the like developed prior to this invention have not been able to adequately address the principle concerns surrounding the use of such devices.

OBJECTS AND SUMMARY OF THE INVENTION

An object of the invention is to provide a beach blanket or the like which will tend to remain in a fully extended state when acted upon by environmental, human or mechanical forces.

Another object of the invention is to provide a beach blanket or the like that can be readily positioned in its fully extended state by a single individual.

A further object of the invention is to provide a weighted beach blanket or the like that can be machine washed and dried.

Still another object of the invention is to provide a weighted beach blanket or the like that can be inexpensively and easily manufactured.

Yet another object of the invention is to provide a beach blanket or the like with a continuous weight means at its outer perimeter edge having substantial thickness for preventing foreign obstacles from soiling the reclining surface.

Still another object of the invention is to provide beach blanket or the like that is readily transportable.

Another object of the invention is to provide a beach blanket or the like that can be easily stored.

A further object of the invention is to provide a beach blanket or the like with pocket retaining means for holding an individual's personal items such as sunglasses, keys, suntan lotion etc.

Another object of the invention is to provide a beach blanket or the like with a continuous weight means along the entire outer perimeter to prevent wind from getting under the blanket and lifting it from the covered surface.

Yet another object of the invention is to provide a beach blanket or the like with a zipper for accessing the weight so that it can be readily filled and drained.

Still another object of the invention is to provide a beach blanket with a reinforcing layer to cushion and secure weight means thereto.

A further object of the invention is to provide a beach blanket or the like with a continuous weight means which is heat resistant.

Another object of the invention is to provide a beach blanket or the like with non-rupturable continuous weight means.

Yet another object of the invention is to provide a beach blanket or the like with a zipper for accessing the weight so that it can be readily filled and drained.

Still another object of the invention is to provide a beach blanket with a reinforcing layer to cushion and secure weight means thereto.

A further object of the invention is to provide a beach blanket or the like with a continuous weight means which is heat resistant.

Another object of the invention is to provide a beach blanket or the like with non-rupturable continuous weight means.

A further object of the invention is to provide a beach blanket or the like with a continuous weight means along the outer perimeter edge having sufficient rigidity to aid an individual in positioning the blanket.

Yet another object of the invention is to provide a beach blanket or the like with a continuous weight means having a memory.

The above and other objects and advantages of the invention will be readily apparent upon consideration of the detailed description of the invention and the claims.

In summary, the present invention discloses a beach blanket or the like having first and second flexible sheets and a continuous weight means extending along and secured to the outer perimeter of the first and second flexible sheets. The weight means consists of a silicone tube having opposing free ends and filled with a liquid, preferably water, and a plug for sealing the liquid within the silicone tube.

DESCRIPTION OF THE DRAWINGS

FIG. 1 is a perspective view of the weighted beach blanket or the like.

DETAILED DESCRIPTION OF THE INVENTION

Figure 1:
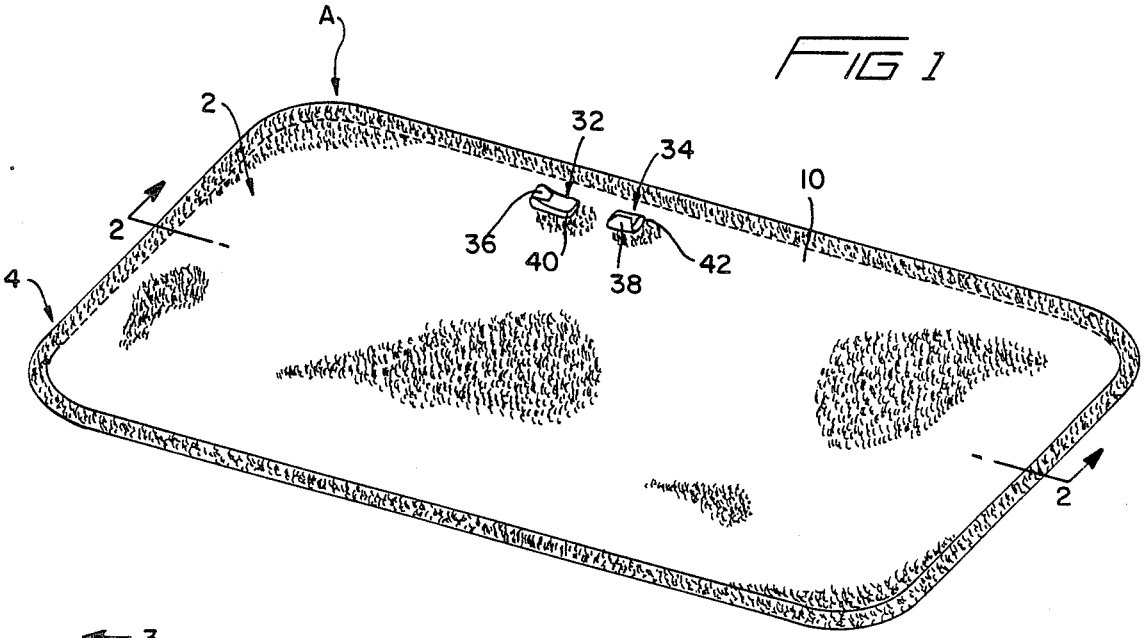
Figure 2:
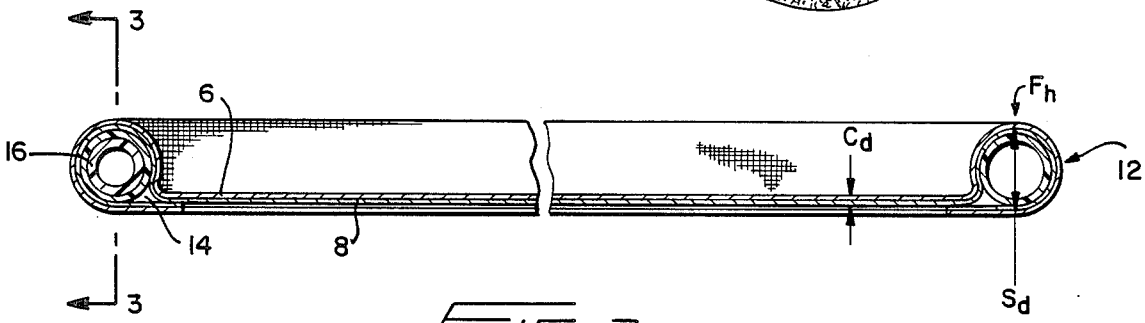
FIG. 2 is a cross-sectional view of FIG. 1 taken along lines 2—2.

FIGS. 1 and 2

Referring to FIG. 1, a weighted beach blanket A includes a main body 2 and a removable anchoring device 4 extending continuously along the outer perimeter of the main body for removably anchoring the weighted beach blanket A to ground surfaces such as beaches, lawns or the like.

Referring to FIG. 2, the main body 2 includes first and second flexible cloth panels 6 and 8 respectively. The first and second flexible cloth panels 6 and 8 are substantially rectangular in shape and identical in size. The first flexible cloth panel 6 has an inner reclining surface 10 whereon an individual either sits or lies. The inner reclining surface 10 is preferably formed from a soft terry cloth material thus, providing an individual with a comfortable surface on which to recline. A flexible cloth panel 8 is superimposed on the first flexible cloth panel 6 and in use is directly adjacent the ground surface. Thus, the second flexible cloth panel 8 is formed from a tightly woven durable fabric such as sail cloth or the like. It is considered well within the knowledge of one of ordinary skill in the art to form the second flexible cloth panel 8 from a water impermeable or moisture resistant material if the weighted beach blanket A is to be used in an environment where the ground surface is very moist. The panel 8 or its fibers may also be treated with a coating to render the panel 8 moisture proof or water resistant.

A border 12 is formed along the outer perimeter edge of the main body 2 of the weighted beach blanket A. The border 12 is formed by folding first and second flexible cloth panels 6 and 8 over and securing the flexible cloth panels 6 and 8 to the underside of the second flexible cloth panel 8 as best shown in FIG. 2. Preferably, stitching is used to secure the first and second flexible cloth panels 6 and 8 to the underside of the second flexible cloth panel 8. However, it will be appreciated by one of ordinary skill in the art that a zipper, hook and loop type fasteners such as the ones sold under the trademark of VELCRO or other conventional fastening devices may be used.

A reinforced retaining pocket 14 is formed continuously along the outer perimeter of the main body 2 of the weighted beach blanket A by border 12. The reinforced retaining pocket 14 secures the anchoring device 4 to the weighted beach blanket A.

Figure 3:
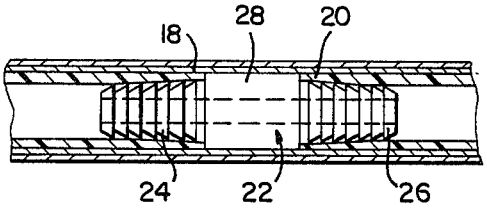
FIG. 3 is a cross-sectional view of FIG. 2 taken along lines 3—3.
Figure 4:
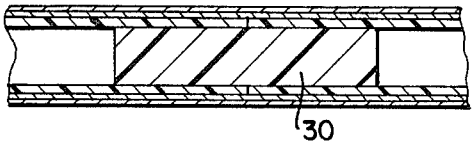
FIG. 4 is an alternative embodiment of the plug disclosed in FIG. 3.
Figure 5:
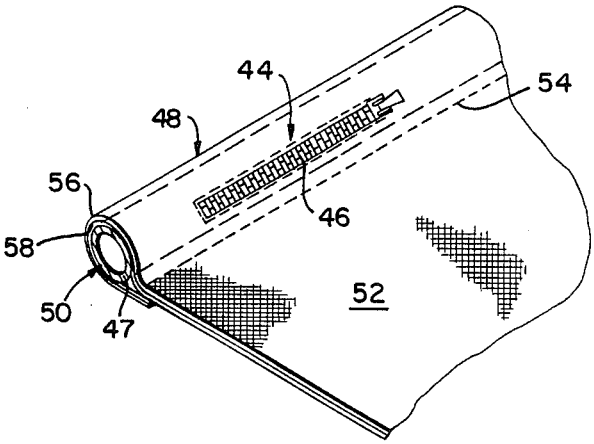
FIG. 5 is a fragmentary perspective view of an alternative embodiment of the weighted beach blanket.

The anchor member 4 includes a non-metallic tube 16 extending continuously through the reinforced retaining pocket 14. Preferably, the non-metallic tube 16 is formed from silicone polymers as they are water impermeable and heat stable. Other materials may be used such as rubber or expoxy compounds. Referring to FIG. 3, the non-metallic tubing 16 has opposing free ends 18 and 20. A plug 22 is inserted into either one of the opposing free ends 18 or 20. The tubing 16 is filled with a liquid weight means (not shown), preferably water, at the free end unobstructed by plug 22. The other end of plug 22 is then inserted into the remaining free end of non-metallic tube 16. The ends 24 and 26 of plug 22 have a plurality of corrugations formed therein to provide a proper seal for the non-metallic tube 16. Mid-section 28 of plug 22 has an outer diameter equal to the outer diameter of the non-metallic tube 16 further enhancing the seal of non-metallic tube 16. The plug 22 can either be heat sealed to the non-metallic tubing 16 or glued thereto. As best seen in FIG. 4, a plug 30 having a uniform cross-sectional area may be used. Plug 30 can be sealingly secured to silicone tube 16 in a similar manner as plug 22.

The second flexible cloth panel 8 reinforces border 12 securely connecting the non-metallic tube 16 to the weighted blanket A. The second flexible cloth panel 8 also acts as a cushion for non-metallic tube 16 thus, preventing any likelihood of rupture of the non-metallic tube 16.

The diameter $S_d$ of border 12 is substantially greater than the combined thickness $C_d$ of the first and second flexible cloth panels 6 and 8,respectively. Thus, a border of sufficient elevation is formed along the outer perimeter of the weighted beach blanket A. This feature prevents foreign obstacles such as sand, dirt and the like from soiling the reclining surface 10 of the weighted beach blanket. An individual, therefore, is able to recline comfortably on a blanket that is free from foreign substances.

The non-metallic tube 16 being formed from an elastic material such as silicone has a memory allowing the non-metallic tube 16 to maintain a constant cross-sectional area. In the event that an external force $F_h$ as in FIG. 2, is applied to the non-metallic tube 16 thereby deforming the tube, on release of the force $F_h$, the tube will recoil to its original position. This aspect of the invention enables the weighted beach blanket A to maintain an elevated border of a specific height at all times aiding in keeping out sand, thus keeping the blanket clean.

The weight means being of a liquid state ensures that a constant weight will be acting at each point along the outer perimeter of the weighted beach blanket A. The importance of this feature will be best be seen by way of example. In use, the anchoring device 4 of the weighted beach blanket A is likely to be stepped on by numerous individuals. This will result in displacement of the weight. Due to the memory feature of the non-metallic tube and the liquid state of the weight means, the liquid will return to any portion of the non-metallic tube which may have been deformed when acted upon by the external force. However, as noted in U.S. Pat. No. 3,862,876, if the weight means is of a granular or particulate nature, the weight means will not readily return to its former position thus causing an uneven distribution of the weight along the outer perimeter of the blanket. This will result in the portion of the blanket without the appropriate weight therein being readily deformed from the blanket's fully extended position.

The weighted beach blanket A of the present invention can be readily machine washed and dried. The durable, non-rupturable, and heat resistant characteristics of the silicone tube 16 enable the weighted beach blanket to be put through numerous wash and dry cycles without resulting in the loss of the liquid weight contained therein or any damage to the washer and dryer units.

Referring to FIG. 1, a plurality of pockets 32 and 34 are secured to the reclining surface 10 of the first flexible cloth panel 6. The pockets 32 and 34 provide convenient compartments for personal articles such as sunglasses, suntan lotion, keys, money etc. The pockets 32 and 34 include removable flaps 36 and 38 respectively. The flaps 36 and 38 are secured to the main bodies 40 and 42 by hook and loop type fasteners such as the ones sold under the trademark of VELCRO (not shown). It will be appreciated by one of ordinary skill in the art that other fastening devices such as zippers and the like can be used to secure the flaps 36 and 38 to bodies 40 and 42 respectively.

SECOND EMBODIMENT

FIG. 5

The second embodiment of the invention is identical to the weighted beaCh blanket A disclosed in FIG. 1 with the addition of an access member generally designated by reference numeral 44. The access member 4 includes a zipper 46 formed in border 48 directly adjacent the plug element of the anchoring member 50. The zipper 46 allows the individual to gain access to the non-metallic tube at the juncture where the plug sealingly connects the opposing free ends of the non-metallic tube. This enables the individual to remove the plug so that the liquid can be drained from the non-metallic tube. It may be desirable to drain the liquid from the non-metallic tube for storage. If the blanket is stored in a tool shed or basement which is subject to extremely cool temperatures in the winter time, the liquid contained within the non-metallic tube would be likely to freeze and thus cause damage to the tube itself. Further, the zipper 46 will allow an individual to remove the anchoring device which will additionally facilitate the storage of the weighted beach blanket. It should be noted that in this embodiment of the weighted beach blanket, the plug used to seal the silicone tube 47 must be of the type that is readily removable. It will be appreciated by one of ordinary skill in the art that conventional plugs of this nature may be used.

The zipper 46 is shown in the portion of border 48 directly adjacent reclining surface 52. It will be appreciated by one of ordinary skill in the art, for cosmetic purposes that the zipper 46 could be formed on the underside of border 48 directly adjacent stitchings 54 securing the first and second flexible cloth panels 56 and 58 to the underside of the second flexible cloth panel 58.

While this invention has been described as having preferred design, it is understood that it is capable of further modification, uses and/or adaptions of the invention following in general the principle of the invention and including such departures from the present disclosure as come within known or customary practice in the art to which the invention pertains, and as may be applied to the essential features set forth, and fall within the scope of the invention of the limits of the appended claims.

I claim:

1. A multi-purpose weighted blanket for covering an area, comprising:

(a) a main body including a first flexible cloth panel, (b) said first flexible cloth panel having a border formed in at least a portion of the outer perimeter thereof, (c) means for removably anchoring said main body to a ground area, (d) said anchoring means including a sealed continuous impermeable tubular member positioned within said border for maintaining said border in an elevated position at all times when said tubular member is not under a substantial pressure, (e) said tubular member being formed from a non-rupturable heat resistant plastic material having a memory, (f) said tubular member having a liquid weight means contained therein for removably anchoring said main body to a ground area, (g) said liquid being returnable, upon removal of said substantial pressure, to any portion of the tubular member which may have collapsed due to said substantial pressure, and (h) said tubular member, when not acted upon by said pressure, having a substantially constant cross-sectional area either when the liquid weight means is contained therein or drained therefrom.

2. A weighted blanket as in claim 1, wherein:

(a) said main body includes a second flexible cloth panel, (b) said second flexible cloth panel is formed from tight woven durable fabric.

3. A weighted blanket as in claim 2, wherein:

(a) said border is formed along the entire outer perimeter of said first and second flexible cloth panels, and (b) said tube means extends continuously through the entire length of said border.

4. A weighted blanket as in claim 2, wherein:

(a) said first and second flexible cloth panels are generally oblong in shape and equal in size.

5. A weighted blanket as in claim 1, wherein:

(a) said tubular member includes a tube having opposing free ends, and (b) said tubular member further includes plug means for sealingly connecting said opposing free ends of said tube for preventing leakage of said liquid weight means contained therein.

6. A weighted blanket as in claim 5, wherein:

(a) said plug means includes a plurality of corrugations formed on at least one end thereof for sealing said opposing ends of said tube.

7. A weighted blanket as in claim 5, wherein:

(a) said plug means is formed from a material having a stiffness substantially greater than said tube.

8. A weighted blanket as in claim 5, wherein:

(a) said tube is formed from silicone.

9. A weighted blanket as in claim 1, wherein:

(a) said first flexible cloth panel includes an inner reclining surface bordered by said anchoring means, and (b) said tubular member has a diameter substantially greater than the sum of the thicknesses of said first and second flexible cloth panels, thereby forming a boundary for preventing foreign obstacles from soiling said inner reclining surface of said first flexible cloth panel.

10. A weighted blanket as in claim 1, wherein:

(a) said border includes means to access said tubular member contained therein for permitting filling and drainage of said liquid weight means.

11. A weighted blanket as in claim 10, wherein:

(a) said access means is a zipper.

12. A weighted blanket as in claim 1, wherein:

(a) said cross-sectional area of said tubular member is substantially circular in shape.

13. A weighted blanket as in claim 1, whercin:

(a) said main body incldues at least one pocket means formed on said first flexible cloth panel for retaining personel articles.

14. A weighted blanket as in claim 1, wherein:

(a) said main body is substantially rectangular in shape.

15. A weighted blanket as in claim 1, wherein:

(a) said first flexible cloth panel is formed from terry cloth.

* * * * *